US012601063B2

(12) United States Patent
Alissa et al.

(10) Patent No.: US 12,601,063 B2
(45) Date of Patent: Apr. 14, 2026

(54) LANDING BASE EXTERNAL CORROSION INHIBITION USING IN-SITU FORMED POLYACRYLAMIDE GEL

(71) Applicant: SAUDI ARABIAN OIL COMPANY, Dhahran (SA)

(72) Inventors: Faisal Mohammed Alissa, Dammam (SA); Norah Waled Aljuryyed, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 809 days.

(21) Appl. No.: 18/054,751

(22) Filed: Nov. 11, 2022

(65) Prior Publication Data

US 2024/0158923 A1 May 16, 2024

(51) Int. Cl.
*C23F 11/173* (2006.01)

(52) U.S. Cl.
CPC ..... *C23F 11/173* (2013.01)

(58) Field of Classification Search
CPC ..... C23F 11/173
See application file for complete search history.

(56) References Cited

U.S. PATENT DOCUMENTS 9,695,350 B2 * 7/2017 Chung ..... C09K 8/68
2014/0083704 A1 3/2014 Sangermano et al.
2014/0187672 A1 7/2014 Zhao et al.
2020/0071601 A1 3/2020 Long et al.
2021/0324113 A1 10/2021 Almohsin et al.
2022/0049035 A1 2/2022 Abdel-Fattah et al.

FOREIGN PATENT DOCUMENTS

JP 2510863 B2 6/1996
WO 2018077743 A2 5/2018

OTHER PUBLICATIONS

Gelfi et al., "Polymerization kinetics of polyacrylamide gels I. Effect of different cross-linkers, " Electrophoresis 1981, 2, 213-219, 7 pages.
Gelfi et al., "Polymerization kinetics of polyacrylamide gels II. Effect of temperature," Electrophoresis 1981, 2, 220-228, 9 pages.
Menter et al., "Acrylamide Polymerization—A Practical Approach," Electrophoresis, 2000, 8 pages.
Righetti et al., "Polymerization kinetics of polyacrylamide gels III. Effect of catalysts," Electrophoresis 1981, 2, 291-295, 5 pages.
Office Action issued in SA Application No. 123450782, dated Oct. 22, 2025 (18 pages).

(Continued)

*Primary Examiner* — Peter F Godenschwager
(74) *Attorney, Agent, or Firm* — Osha Bergman Watanabe & Burton LLP

(57) ABSTRACT

A method of corrosion inhibition of a topside well equipment includes disposing a fluid mixture including an acrylamide monomer, a comonomer, and an initiator within a well cellar, agitating the fluid mixture and initiating polymerization of the acrylamide monomer and the comonomer, and forming a coating on the topside well equipment, wherein the coating is impermeable to water.

17 Claims, 1 Drawing Sheet

(56) References Cited

OTHER PUBLICATIONS

Tong Han et al., "Insights into the multiple applications of modified polyacrylamide as oilfield corrosion inhibitor and water phase tackifier", Petroleum Science 19 (2022) 397-408 (12 pages).
Arpaporn Sutipatanasomboon et al., "Polyacrylamide Gel Electrophoresis", Conductscience Inc, 2021, https://conductscience.com/polyacrylamide-gel./electrophoresis (12 pages).

* cited by examiner

LANDING BASE EXTERNAL CORROSION INHIBITION USING IN-SITU FORMED POLYACRYLAMIDE GEL

BACKGROUND

Oilfield wells are composed of several components including the wellhead, bottom-hole assembly, and well casings. The well is placed in a well cellar, which protects against the formation breaking down and collapsing in on the well. Often, the cellar is bedded into and filled with sand. In areas of high moisture, such as, for example, rainy areas and areas with nearby water-sources, the sand may get wet, facilitating external corrosion of topside well components, such as the wellhead and casings.

Additionally, corrosion is highly prevalent in water injector wells due to air exposure and continuous water flow. Initially, the flange connecting the injection line corrodes. Such corrosion may cause water to leak onto the sand covering the well cellar, which ultimately leads to external corrosion of other topside well equipment. Fortunately, the accessibility of the injection line flange makes it easy to replace. However, replacement or repair of externally corroded surface casings requires excavation of the wellhead, making it much more difficult. Even more challenging, is the corrosion of inaccessible components that are not able to be repaired. One such component is the landing base of a well.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a method of corrosion inhibition of a topside well equipment that includes disposing a fluid mixture including an acrylamide monomer, a comonomer, and an initiator within a well cellar, agitating the fluid mixture and initiating polymerization of the acrylamide monomer and the comonomer, and forming a coating on the topside well equipment, wherein the coating is impermeable to water.

Other aspects and advantages of the claimed subject matter will be apparent from the following description and the appended claims.

DETAILED DESCRIPTION

Oilfield wells are often placed in and surrounded by a well cellar that provides stability against the formation. In particular, the wellhead, which is at the surface of a well, may be provided within the cellar. Topside equipment, such as the wellhead, may be susceptible to corrosion due to external water and oxygen exposure. Such corrosion may be intensified by the presence of sand, which may partially fill the well cellar and bury certain components of the wellhead. The wellhead provides the structural and pressure-containing interface for drilling and production equipment, and as such, each component of a wellhead should be properly maintained and replaced upon instances of corrosion.

Figure 1:
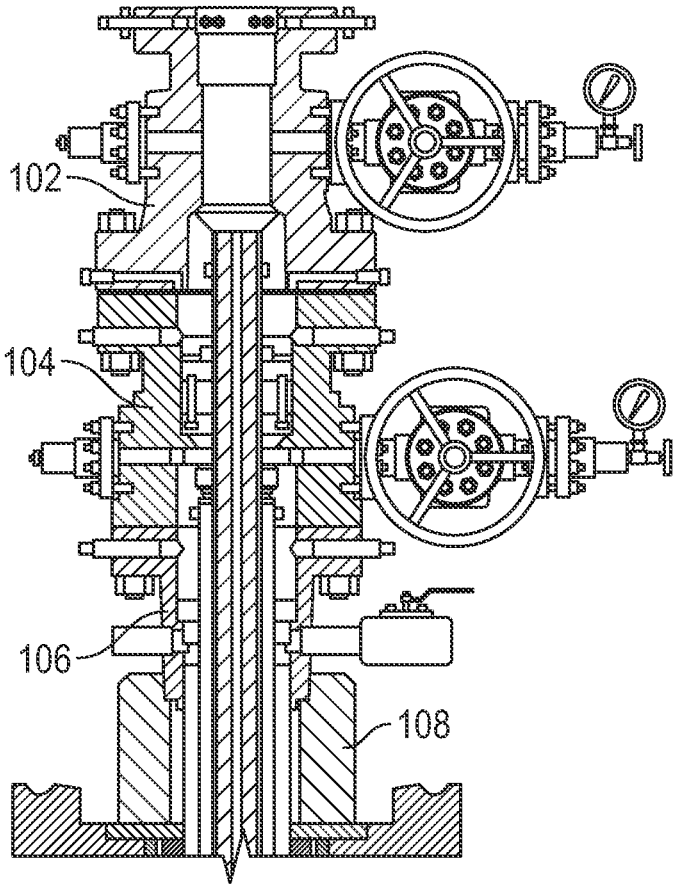
FIG. 1 is a schematic illustration of a wellhead in accordance with one or more embodiments of the present disclosure.

A wellhead schematic is shown in FIG. 1. FIG. 1 shows components of the wellhead such as the tubing spool 102, casing spool 104, landing base 106, and base plate 108. In the field, the landing base 106 and base plate 108 may be embedded in sand within the well cellar, sometimes extending 5 to 15 feet below the surface of the sand. As sand has an ability to retain water, these components in particular are susceptible to severe corrosion caused by exposure to water, oxygen, and sand. Such corrosion is quite problematic as it often requires equipment replacement.

Embodiments disclosed herein relate to a method of inhibiting corrosion of topside well equipment. As described above, topside equipment may be susceptible to corrosion in the presence of oxygen, water, and sand. Thus, the method may inhibit corrosion of equipment that is exposed to oxygen, water, and sand. In one or more embodiments, the method may be directed to corrosion inhibition of a landing base. The method may include forming, in situ, an impermeable gel layer over a landing base. In particular, the gel layer may be impermeable to water.

Figure 2:
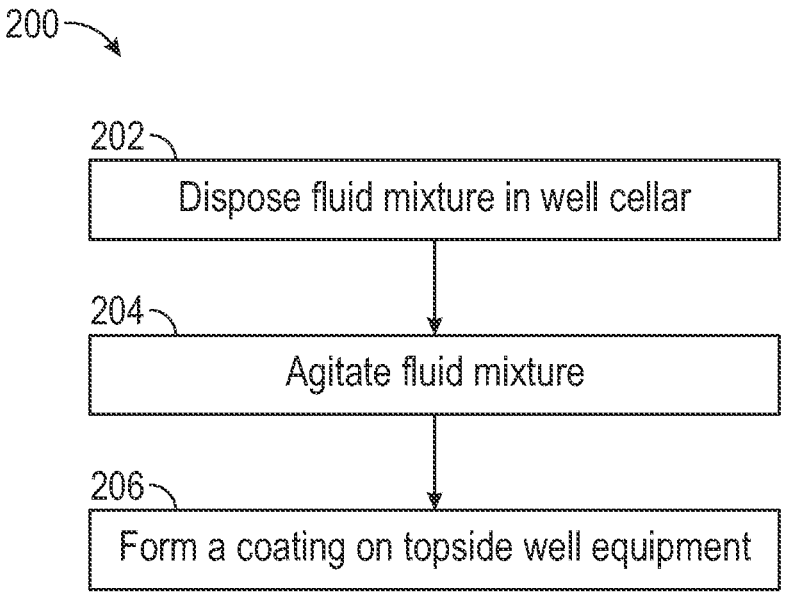
FIG. 2 is a block-flow diagram of a method in accordance with one or more embodiments of the present disclosure.

A method of corrosion inhibition in accordance with one or more embodiments of the present disclosure is shown in, and discussed with reference to, FIG. 2. The method may be applied to an existing well or a newly drilled well. As described above, the well may be surrounded by a well cellar. When the well is an existing well, the well cellar may be embedded into and filled with sand. Accordingly, in embodiment methods directed to corrosion inhibition of an existing well, the well cellar is initially excavated. The well cellar may be excavated according to any means known for excavation, provided that the topside equipment is left intact and undamaged. The well cellar may be excavated to a depth of about 5 to about 15 feet. As such, after excavation, the well cellar may include little to no sand and certain components of the topside equipment that are usually embedded in the sand may be exposed. For example, components of the topside equipment that may be accessible after excavation of the well cellar include the landing base, surface casing, and base plate.

Alternatively, when a well is newly drilled, the well cellar may be unfilled, and as a result, may not require excavation to expose components of the topside well equipment. Similar to an excavated well cellar of an existing well, the well cellar of a newly drilled well may have a depth ranging from about 5 to about 15 feet.

After providing an unfilled well cellar, method 200 includes disposing a fluid mixture into the well cellar 202. The fluid mixture may include an initiator and one or more monomers that may be polymerized to form a gel. The mixture may be formed in situ within the well cellar via pouring or pumping of the respective components into the well cellar. In the case of a conventional cellar, measuring from about 1.5 to 3.0 meters in diameter, the excavated cellar may have an unoccupied volume of about 17 to 135 Barrels (bbls). In one or more embodiments, the fluid mixture may be included in the well cellar in an amount ranging from 5.0 to 50 bbls, depending on the volume of the well cellar. For example, an amount of the fluid mixture that is disposed into the well cellar may range from a lower limit of one of 5.0, 10, 15, 20, and 25 bbls to an upper limit of one of 30, 35, 40, 45, and 50 bbls, where any lower limit may be paired with any mathematically compatible upper limit.

As described above, the fluid mixture may include one or more monomers that may be polymerized to form a gel. In one or more embodiments, the fluid mixture includes an acrylamide monomer and a comonomer. Suitable acrylamide monomers include, but are not limited to, N,N-methylenebisacrylamide (Bis), N,N-(1,2-dihydroxyethylene) bisacrylamide (DHEBA), ethylene diacrylate (EDA), N,N-bisacrylylcystamine (BAC), N,N-diallyltartardiamide (DATD), piperazine di-acrylamide (PDA), ethylene glycol dimethacrylate (EGDMA), and acrylamide. In particular embodiments, the first fluid includes acrylamide.

The fluid mixture may include an acrylamide monomer in a concentration ranging from about 15 to about 35 wt. % in water, based on the total weight of the fluid mixture. For example, in one or more embodiments, the acrylamide monomer is present in the fluid mixture in a concentration ranging from an upper limit of one of 15, 17, 20, 22, and 25 wt. %, to an upper limit of one of 25, 27, 30, 32, and 35 wt. %, where any lower limit may be paired with any mathematically compatible upper limit.

In one or more embodiments, the fluid mixture includes a comonomer. The comonomer may be any suitable comonomer known in the art to form a gel when polymerized with acrylamide. For example, suitable comonomers include, but are not limited to, N,N'-methylenebisacrylamide, N,N'-(1,2-dihydroxyethylene) bisacrylamide, and a combination thereof.

The fluid mixture may include a comonomer in an amount ranging from about 3.0 to about 20 wt. % in water, based on the total weight of the fluid mixture. For example, in one or more embodiments, the comonomer is present in the fluid mixture in an amount ranging from a lower limit of one of 2.0, 3.0, 5.0, 8.0, and 10 wt. % to an upper limit of one of 10, 12, 14, 16, and 18 wt. %, where any lower limit may be paired with any mathematically compatible upper limit.

In one or more embodiments, the fluid mixture includes one or more initiators. Any initiator commonly used in the art may be included in the fluid mixture, provided that it is capable of initiating polymerization of an acrylamide monomer and a comonomer at ambient conditions. Suitable initiators include, but are not limited to, tetramethyl ethylenediamine (TMEDA), ammonium persulfate, and combinations thereof. In one or more embodiments, the fluid mixture includes TMEDA and ammonium persulfate.

In one or more embodiments, the fluid mixture includes a first initiator and a second initiator. The first initiator may be responsible for initiating the polymerization between an acrylamide monomer and a comonomer and the second initiator may act as a catalyst for the polymerization. In such embodiments, the first initiator may be TMEDA and the second initiator may be ammonium persulfate.

In embodiments in which a first initiator and a second initiator are included in the fluid mixture, the first initiator may be included in the fluid mixture an amount ranging from 1.0 to 20 vol %, based on the total volume of the fluid mixture. For example, in one or more embodiments, the first initiator may be included in the fluid mixture in an amount ranging from a lower limit of one of 1.0, 2.0, 5.0, and 10 wt. % to an upper limit of one of 10, 12, 15, 17, and 20 w.t %, where any lower limit may be paired with any mathematically compatible upper limit.

In such embodiments, the fluid mixture may include a second initiator in an amount ranging from 0.5 wt. % to 15 wt. %, based on the total weight of the fluid mixture. For example, in one or more embodiments, the initiator is present in the fluid mixture in an amount ranging from a lower limit of one of 0.5, 1.0, 2.0, and 5.0 wt. %, to an upper limit of one of 7.0, 10, 12, and 15 wt. %, where any lower limit may be paired with any mathematically compatible upper limit.

In one or more embodiments, the fluid mixture optionally includes an oxygen scavenger. An oxygen scavenger may be included in the fluid mixture to enhance the corrosion inhibition of the gel formed via polymerization of the first fluid, which may be beneficial in some embodiments. Exemplary oxygen scavengers include sulfite based oxygen scavengers such as sodium sulfite ($Na_2SO_3$), potassium sulfite ($K_2SO_3$), and ammonium sulfite ($(NH_4)_2SO_3$); polymeric sulfur based oxygen scavengers; and commercially available oxygen scavengers such as OXYGON; among others.

In embodiments in which an oxygen scavenger is included in the fluid mixture, the fluid mixture may include the oxygen scavenger in an amount ranging from 0.5 to 3.0 wt. %, based on the total weight of the fluid mixture. For example, in one or more embodiments, an oxygen scavenger is present in the fluid mixture in an amount ranging from a lower limit of one of 0.5, 0.7, 1.0, 1.2, and 1.5 wt. % to an upper limit of one of 1.5, 2.0, 2.5, and 3.0 wt. %, where any lower limit may be paired with any mathematically compatible upper limit.

In one or more embodiments, the fluid mixture optionally includes a corrosion inhibitor. A corrosion inhibitor may be included in the fluid mixture to enhance the corrosion inhibition of the gel formed via polymerization of the fluid mixture, which may be beneficial in some embodiments. Exemplary corrosion inhibitors include quaternary ammonium compounds, chlorides, among others. In particular embodiments, the corrosion inhibitor is a commercially available corrosion inhibitor such as O-3670R.

In embodiments in which a corrosion inhibitor is included in the fluid mixture, the fluid mixture may include the corrosion inhibitor in an amount ranging from 4.0 to 10 wt. %, based on the total weight of the first fluid. For example, in one or more embodiments, a corrosion inhibitor is present in the fluid mixture in an amount ranging from a lower limit of one of 4.0, 4.5, 5.0, 5.5, 6.0, 6.5, and 7.0 wt. % to an upper limit of one of 7.0, 7.5, 8.0, 8.5, 9.0, 9.5, and 10 wt. %, where any lower limit may be paired with any mathematically compatible upper limit.

In one or more embodiments, the fluid mixture is disposed in the well cellar in two separate stages. As such, in some embodiments, a first fluid may be disposed in the well cellar followed by a second fluid. The first fluid may include the one or more monomers, such as, for example, an acrylamide monomer and a comonomer. The second fluid may include the initiator. Accordingly, the first fluid may be disposed in the well cellar separately from the second fluid in order to prevent premature polymerization. Thus, the second fluid may be disposed in the well cellar at a desired time to facilitate polymerization of the one or more monomers that are present in the first fluid. If the second fluid is added to the well cellar too quickly, the polymerization may occur quickly, and the gel layer may not be formed properly, e.g., the gel layer may have an irregular shape. Thus, in one or more embodiments, the second fluid is added to the first fluid in the well cellar in a controlled manner, such as in portions or dropwise. Controlled addition of the second fluid may enable the gel layer to properly take the shape of the well cellar.

In embodiments in which the method includes initially disposing a first fluid and subsequently disposing a second fluid, the first fluid may by included in the well cellar in an amount of ranging from 5 to 40 bbls, depending on the volume of the well cellar. For example, an amount of the first fluid that is disposed into the well cellar may range from a lower limit of one of 5.0, 10, 15, and 20 bbls to an upper limit of one of 25, 30, 35, and 40 bbls, where any lower limit may be paired with any mathematically compatible upper limit. In one or more embodiments, the first fluid includes one or more comonomers. In particular embodiments, the first fluid includes an acrylamide monomer and a comonomer as previously described. The acrylamide monomer may be present in the first fluid in an amount ranging from about 20 to about 40 wt. % in water. For example, in one or more embodiments, the acrylamide monomer is present in the first fluid in an amount ranging from an upper limit of one of 20, 22, 24, 26, 28, and 30 wt. %, to an upper limit of one of 30, 32, 34, 36, 38, and 40 wt. %, where any lower limit may be paired with any mathematically compatible upper limit.

The comonomer may be present in the first fluid in an amount ranging from about 3.0 to about 20 wt. %, based on the total weight of the first fluid. For example, in one or more embodiments, the comonomer is present in the first fluid in an amount ranging from a lower limit of one of 3.0, 5.0, 8.0, and 10 wt. % to an upper limit of one of 12, 14, 16, 18, sand 20 wt. %, where any lower limit may be paired with any mathematically compatible upper limit.

In some embodiments, the first fluid optionally includes an oxygen scavenger, a corrosion inhibitor, or a combination thereof. The oxygen scavenger and corrosion inhibitor are as previously described. The first fluid may include an oxygen scavenger in an amount ranging from 1.0 to 3.0 wt. %, based on the total weight of the first fluid. For example, in one or more embodiments, an oxygen scavenger is present in the first fluid in an amount ranging from a lower limit of one of 1.0, 1.2, 1.4, 1.6, 1.8, and 2.0 wt. % to an upper limit of one of 2.0, 2.2, 2.4, 2.6, 2.8, and 3.0 wt. %, where any lower limit may be paired with any mathematically compatible upper limit.

A corrosion inhibitor may be included in the first fluid in an amount ranging from 5.0 to 10 wt. %, based on the total weight of the first fluid. For example, in one or more embodiments, a corrosion inhibitor is present in the first fluid in an amount ranging from a lower limit of one of 5.0, 5.5, 6.0, 6.5, 7.0, and 7.5 wt. % to an upper limit of one of 7.5, 8.0, 8.5, 9.0, 9.5, and 10 wt. %, where any lower limit may be paired with any mathematically compatible upper limit.

The first fluid may include an aqueous base fluid. In one or more embodiments, the aqueous base fluid includes water. Suitable aqueous base fluids include, but are not limited to, fresh water, deionized water, distilled water, seawater, and combinations thereof. The aqueous base fluid may be included in the first fluid in an amount ranging from 20 to 40 wt. %, based on the total weight of the first fluid. For example, in one or more embodiments, the first fluid includes an aqueous base fluid in an amount ranging from a lower limit of one of 20, 22, 24, 26, 28, and 30 wt. % to an upper limit of one of 30, 32, 34, 36, 38, and 40 w.t %, where any lower limit may be paired with any mathematically compatible upper limit.

In embodiments in which the method includes initially disposing a first fluid and subsequently disposing a second fluid, the second fluid may be disposed in the well cellar in an amount ranging from 2.0 to 10 bbls. For example, in one or more embodiments, the second fluid is included in the well cellar in an amount ranging from a lower limit of one of 2.0, 3.0, 4.0, and 5.0 bbls to an upper limit of one of 6.0, 7.0, 8.0, 9.0, and 10 bbls, where any lower limit may be paired with any mathematically compatible upper limit.

As described above, the second fluid may be added to facilitate polymerization of the one or more monomers present in the first fluid. As such, the second fluid may include an initiator as previously described. In one or more embodiments, the second fluid includes a first initiator and a second initiator, as described above. The first and second initiator may be mixed together in the second fluid to form an initiator pill before the second fluid is added to the well cellar. The first initiator may be added to the second fluid in a concentration ranging from 40 to 60 wt. % in water. For example, in one or more embodiments, the first initiator is added to the second fluid in a concentration in water ranging from a lower limit of one of 40, 42, 44, 46, 48, and 50 wt. %, to an upper limit of one of 50, 52, 54, 56, 58, and 60 wt. %, where any lower limit may be paired with any mathematically compatible upper limit. In one or more embodiments, the second initiator is added to the second fluid neat, i.e., without dilution or dissolution in any solvent.

The second fluid may include an aqueous base fluid. In one or more embodiments, the aqueous base fluid includes water. Suitable aqueous base fluids include, but are not limited to, fresh water, deionized water, distilled water, seawater, and combinations thereof. The aqueous base fluid may be included in the second fluid in an amount ranging from 40 to 60 wt. %, based on the total weight of the first fluid. For example, in one or more embodiments, the first fluid includes an aqueous base fluid in an amount ranging from a lower limit of one of 40, 42, 44, 46, 48, and 50 wt. % to an upper limit of one of 50, 52, 54, 56, 58, and 60 wt. %, where any lower limit may be paired with any mathematically compatible upper limit.

Optionally, in one or more embodiments, the second fluid includes a suitable amount of sand. Any type of sand known in the art may be disposed in the well cellar such as, for example, silica sand, native desert sand, among others. A suitable amount of sand that may be added to the well cellar may range from about 1 to 1000 grams. For example, in one or more embodiments, the amount of sand added to the well cellar may range from a lower limit of one of 1, 5, 10, 50, 100, 200, and 300 grams to an upper limit of one of 400, 500, 600, 700, 800, 900, and 1000 grams, where any lower limit may be paired with any mathematically compatible upper limit.

In embodiments in which sand is added to the second fluid, the gel layer formed may be a reinforced gel layer. For example, a gel layer formed with sand may have a higher mechanical strength than a gel layer without sand. The fluid mixture in embodiments that include adding sand to the viscous solution may preferably include an oxygen scavenger and/or a corrosion inhibitor as previously described to prevent the fluid from causing corrosion. Thus, such gel layers may exhibit enhanced corrosion inhibition than sand alone and greater mechanical strength than polymerized gel layers alone.

After disposing the fluid mixture in the well cellar, method 200 includes agitating the fluid mixture so as to initiate polymerization of the one or more monomers 204. The fluid mixture may be agitated according to any method known in the art, such as, for example, with a mechanical mixer, such as a large handheld mixer with a long mixing rod.

In one or more embodiments, the fluid mixture may be agitated inside the well cellar for an amount of time sufficient to form a viscous solution. For example, a viscous solution may be formed after mixing the first and second fluids for an amount of time sufficient for the fluid mixture to exhibit an increase viscosity. Viscosity of the fluid mixture may be determined according to methods known in the art. In one or more embodiments, the increase in viscosity is qualitatively observed. After the viscosity of the fluid mixture increases, the mixture may no longer be agitated.

In some embodiments, after formation of a viscous solution, the method may include forming a coating over topside well equipment in the well cellar 206. Such coating may be formed after allowing the viscous solution to cure for an amount of time. For example, a coating may be formed over a landing base after allowing the viscous solution to cure for about 10 to 30 minutes at surface temperature and atmospheric pressure. In one or more embodiments, the viscous solution is allowed to cure over the landing base for an amount of time ranging from a lower limit of one of 10, 12, 14, 16, 18, and 20 minutes to an upper limit of one of 20, 22, 24, 26, 28, and 30 minutes, where any lower limit may be paired with any mathematically compatible upper limit.

The coating formed according to methods of the present disclosure may be impenetrable to water. As such, in one or more embodiments, the coating inhibits corrosion of topside well equipment, in particular the landing base, that is caused due to exposure to oxygen and water. As a result, embodiments herein may minimize or prevent the need to repair and replace wellhead equipment, and thus, lower costs associated with maintenance of such equipment.

EXAMPLES

Acrylamide, N,N'-methylenebisacrylamide, N,N'-(1,2-dihydroxyethylene) bisacrylamide, tetramethyl ethlyenediamine, ammonion persulfate, and $Na_2SO_3$ were obtained from commercial suppliers. The corrosion inhibitor O-3670R was obtained from ChampionX and included the following active ingredients: quaternary ammonium compounds, benzyl-C12-16-alkyldimethyl, and chlorides. Sand was native sand obtained from the desert.

Example 1

A first fluid including acrylamide and piperazine-di-acrylamide was added to a glass tube, followed by a second fluid including TMEDA and ammonium persulfate. Then, the glass tube was shaken by hand to mix the solution. The gel was formed and precipitated on the bottom of the tube to form an impermeable gel layer.

Example 2

A first fluid including acrylamide was added to a glass tube, followed by a second fluid including TMEDA and ammonium persulfate. Then, the glass tube was shaken by hand to mix the solutions. The gel was formed between the sand to provide an impermeable sand/gel layer.

Example 3

A first fluid including acrylamide, N,N-methylenebisacrylamide, $Na_2SO_3$, and O-3670R was added to a glass tube, followed by a second fluid including TMEDA and ammonium persulfate. Then, the glass tube was shaken by hand to mix the solutions. The gel was formed between the sand to provide an impermeable sand/gel layer.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A method of corrosion inhibition of a topside well equipment comprising:

disposing a fluid mixture comprising an acrylamide monomer, a comonomer, and an initiator within a well cellar;

agitating the fluid mixture and initiating polymerization of the acrylamide monomer and the comonomer; and forming a coating on the topside well equipment, wherein the coating is impermeable to water.

2. The method of claim 1, wherein the fluid mixture comprises the acrylamide monomer in an amount ranging from 15 to 35 wt. %, based on the total weight of the fluid mixture.

3. The method of claim 1, wherein the fluid mixture comprises the comonomer in an amount ranging from 2.0 to 16 wt. %, based on the total weight of the fluid mixture.

4. The method of claim 1, wherein the comonomer is selected from the group consisting of N,N'-methylenebisacrylamide, N,N'-(1,2-dihydroxyethylene) bisacrylamide, and a combination thereof.

5. The method of claim 1, wherein the fluid mixture comprises the initiator in an amount ranging from 5 to 20 wt. %, based on the total weight of the fluid mixture.

6. The method of claim 5, wherein the fluid mixture further comprises an oxygen scavenger, a corrosion inhibitor, or a combination thereof.

7. The method of claim 1, wherein the initiator is selected from the group consisting of tetramethyl ethylenediamine (TMEDA), ammonium persulfate, and combinations thereof.

8. The method of claim 1, wherein the fluid mixture further comprises sand.

9. The method of claim 1, further comprising, prior to disposing a fluid mixture, excavating the well cellar.

10. The method of claim 1, wherein the topside well equipment is a landing base.

11. A method of corrosion inhibition of a topside well equipment comprising:

disposing a first fluid comprising an acrylamide monomer and a comonomer within a well cellar;

disposing a second fluid comprising an initiator within the well cellar, agitating the first fluid and the second fluid and initiating polymerization of the acrylamide monomer and the comonomer; and forming a coating on the topside well equipment, wherein the coating is impermeable to water.

12. The method of claim 11, wherein the first fluid comprises the acrylamide monomer in an amount ranging from 20 to 40 wt. %, based on the total weight of the first fluid.

13. The method of claim 11, wherein the first fluid comprises the comonomer in an amount ranging from 3.0 to 20 wt. %, based on the total weight of the first fluid.

14. The method of claim 11, wherein the second fluid comprises a first initiator and a second initiator.

15. The method of claim 11, wherein the first fluid further comprises an oxygen scavenger, a corrosion inhibitor, or a combination thereof.

16. The method of claim 15, wherein the oxygen scavenger is present in an amount ranging from 1.0 to 3.0 wt. %, based on the total amount of the first fluid.

17. The method of claim 15, wherein the corrosion inhibitor is present in an amount ranging from 5.0 to 10 wt. %, based on the total amount of the first fluid.

* * * * *